US007114352B2

(12) United States Patent
Prosser et al.

(10) Patent No.: US 7,114,352 B2
(45) Date of Patent: Oct. 3, 2006

(54) CRYOGENIC AIR SEPARATION SYSTEM FOR PRODUCING ELEVATED PRESSURE NITROGEN

(75) Inventors: Neil Mark Prosser, Lockport, NY (US); Peter James Rankin, Williamsville, NY (US)

(73) Assignee: Praxair Technology, Inc., Danbury, CT (US)

( * ) Notice: Subject to any disclaimer, the term of this patent is extended or adjusted under 35 U.S.C. 154(b) by 377 days.

(21) Appl. No.: 10/743,797

(22) Filed: Dec. 24, 2003

(65) Prior Publication Data

US 2005/0138960 A1 Jun. 30, 2005

(51) Int. Cl.
*F25J 3/00* (2006.01)

(52) U.S. Cl. ..... 62/651

(58) Field of Classification Search ..... 62/651, 62/654, 646, 43, 22, 24
See application file for complete search history.

(56) References Cited

U.S. PATENT DOCUMENTS

| | | | | |
|---|---|---|---|---|
| 4,453,957 | A | 6/1984 | Pahade et al. | 62/25 |
| 4,783,209 | A | 11/1988 | Erickson | 62/22 |
| 5,108,476 | A * | 4/1992 | Dray et al. | 62/646 |
| 5,114,452 | A * | 5/1992 | Dray | 62/646 |
| 5,197,296 | A | 3/1993 | Prosser et al. | 62/39 |
| 5,287,704 | A * | 2/1994 | Rathbone | 62/646 |
| 5,412,953 | A | 5/1995 | Darredeau et al. | 62/25 |
| 5,675,977 | A | 10/1997 | Prosser | 62/646 |
| 5,758,515 | A * | 6/1998 | Howard | 62/646 |
| 6,286,336 | B1 | 9/2001 | Prosser | 62/648 |
| 6,543,253 | B1 | 4/2003 | Schaub et al. | 62/643 |

* cited by examiner

*Primary Examiner*—Melvin Jones
(74) *Attorney, Agent, or Firm*—David M. Rosenblum

(57) ABSTRACT

A cryogenic air separation system for producing elevated pressure nitrogen wherein a portion of the nitrogen product fed to the product compressor downstream of the primary heat exchanger is withdrawn as refrigerant nitrogen from the product compressor, preferably from an intermediate point of the product compressor, and turboexpanded to generate refrigeration for the system.

19 Claims, 1 Drawing Sheet

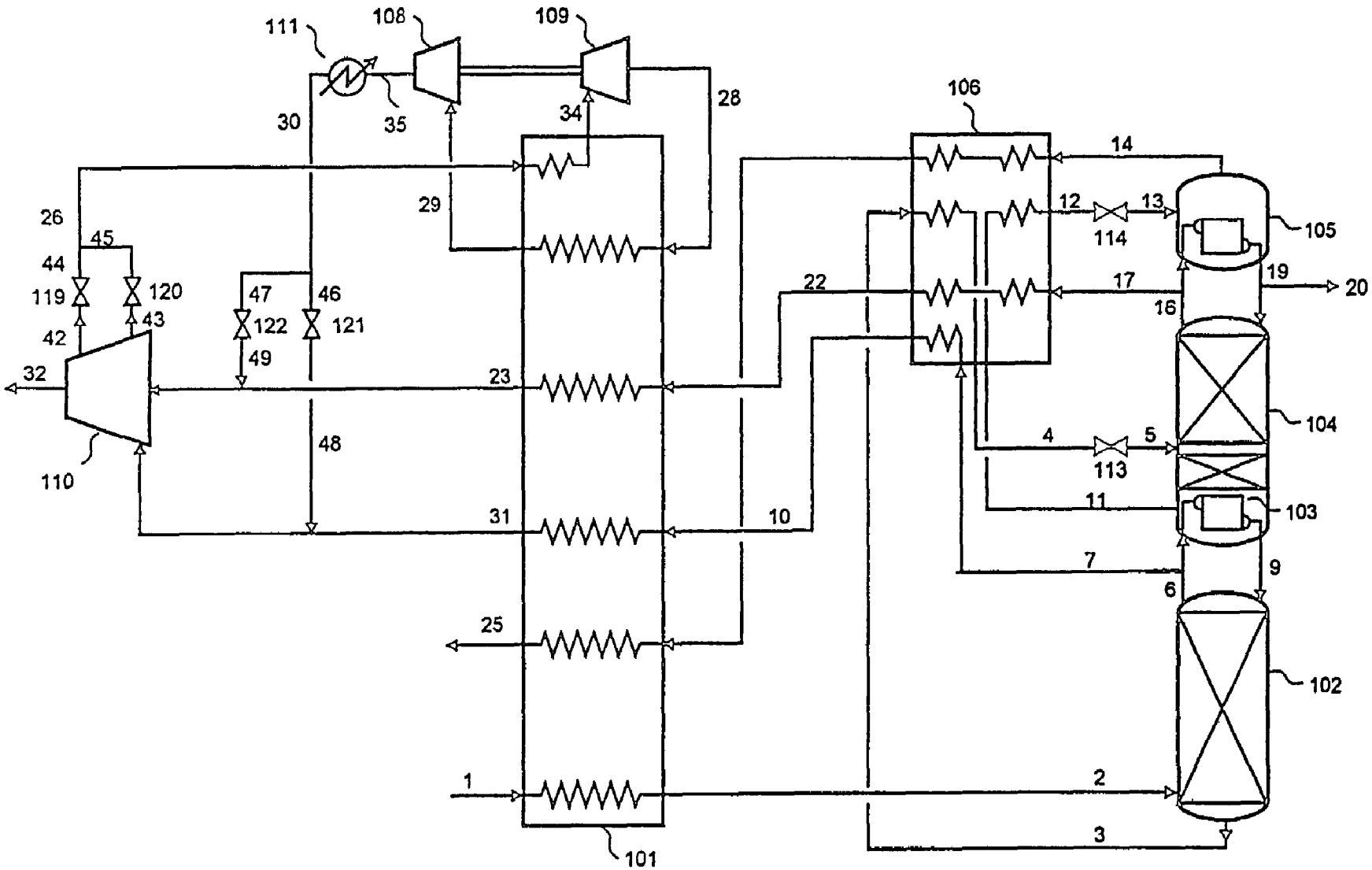
20
105
104
103
102
19
9
13
16
5
6
14
114
17
113
11
7
2
3
12
4
106
22
10
28
101
109
34
23
31
25
1
29
108
35
111
30
46
121
48
47
122
49
120
43
45
26
44
119
42
32
110

CRYOGENIC AIR SEPARATION SYSTEM FOR PRODUCING ELEVATED PRESSURE NITROGEN

TECHNICAL FIELD

This invention relates generally to cryogenic air separation and, more particularly, to cryogenic air separation for the production of elevated pressure nitrogen.

BACKGROUND ART

Processes such as enhanced oil recovery require large quantities of elevated pressure nitrogen which is produced by the cryogenic separation of air. The efficient production of refrigeration for such air separation systems is particularly important, especially if some liquid product is also desired. Moreover, fluctuating demand for liquid product increases the need for an effective refrigeration generation arrangement.

In systems that employ feed air expansion, increased liquid demand significantly diminishes product recoveries, necessitating large increases in power consumption and requiring unreasonable range-ability of feed compressors. For double column nitrogen plants, the large drop in nitrogen recovery also leads to a large change in column pressures. This also results in poor plant operability. In systems that employ waste expansion, increased liquid demand necessitates significant increases in column pressures, which hurts product recoveries and greatly increases the plant's power consumption. The changing column pressures negatively affect plant operability. Systems that employ conventional modes of product nitrogen expansion fall short in one of two ways: (1) Increased liquid demand requires unreasonable rangeability of the lower stages of the product compressor, or (2) If designed to properly accommodate variable liquid demand, existing product expansion methods require multiple turbines and operate at high pressures that severely limit heat exchanger core choices.

Accordingly, it is an object of this invention to provide an improved system for producing elevated pressure nitrogen by the cryogenic separation of air.

SUMMARY OF THE INVENTION

The above and other objects, which will become apparent to those skilled in the art upon a reading of this invention, are attained by the present invention, one aspect of which is:

Cryogenic air separation apparatus for producing elevated pressure nitrogen comprising:

(A) a primary heat exchanger, a cryogenic air separation plant, and means for passing feed air to the primary heat exchanger and from the primary heat exchanger to the cryogenic air separation plant;

(B) a product compressor having a plurality of stages, a turboexpander, means for passing nitrogen from the cryogenic air separation plant to the primary heat exchanger and from the primary heat exchanger to the product compressor, and means for passing nitrogen from the product compressor to the primary heat exchanger and from the primary heat exchanger to the turboexpander;

(C) a booster compressor, means for passing nitrogen from the turboexpander to the primary heat exchanger and from the primary heat exchanger to the booster compressor, and means for passing nitrogen from the booster compressor to the product compressor; and (D) means for recovering elevated pressure nitrogen from the product compressor.

Another aspect of the invention is:

A method for producing elevated pressure nitrogen comprising:

(A) cooling feed air in a primary heat exchanger, passing the cooled feed air into a cryogenic air separation plant, and producing nitrogen by cryogenic rectification within the cryogenic air separation plant;

(B) warming nitrogen withdrawn from the cryogenic air separation plant in the primary heat exchanger, compressing the warmed nitrogen in a product compressor, passing a portion of the compressed nitrogen as refrigerant nitrogen to the primary heat exchanger, cooling the refrigerant nitrogen, and turboexpanding the refrigerant nitrogen to generate refrigeration;

(C) warming the turboexpanded refrigerant nitrogen in the primary heat exchanger, compressing the turboexpanded refrigerant nitrogen in a booster compressor, and passing the resulting refrigerant nitrogen to the product compressor; and (D) recovering elevated pressure nitrogen from the product compressor.

As used herein, the term "column" means a distillation or fractionation column or zone, i.e. a contacting column or zone, wherein liquid and vapor phases are countercurrently contacted to effect separation of a fluid mixture, as for example, by contacting of the vapor and liquid phases on a series of vertically spaced trays or plates mounted within the column and/or on packing elements such as structured or random packing. For a further discussion of distillation columns, see the Chemical Engineer's Handbook, fifth edition, edited by R. H. Perry and C. H. Chilton, McGraw-Hill Book Company, New York, Section 13, *The Continuous Distillation Process*. The term, double column is used to mean a higher pressure column having its upper end in heat exchange relation with the lower end of a lower pressure column. A further discussion of double columns appears in Ruheman "The Separation of Gases", Oxford University Press, 1949, Chapter VII, Commercial Air Separation.

Vapor and liquid contacting separation processes depend on the difference in vapor pressures for the components. The high vapor pressure (or more volatile or low boiling) component will tend to concentrate in the vapor phase whereas the low vapor pressure (or less volatile or high boiling) component will tend to concentrate in the liquid phase. Partial condensation is the separation process whereby cooling of a vapor mixture can be used to concentrate the volatile component(s) in the vapor phase and thereby the less volatile component(s) in the liquid phase. Rectification, or continuous distillation, is the separation process that combines successive partial vaporizations and condensations as obtained by a countercurrent treatment of the vapor and liquid phases. The countercurrent contacting of the vapor and liquid phases is generally adiabatic and can include integral (stagewise) or differential (continuous) contact between the phases. Separation process arrangements that utilize the principles of rectification to separate mixtures are often interchangeably termed rectification columns, distillation columns, or fractionation columns. Cryogenic rectification is a rectification process carried out at least in part at temperatures at or below 150 degrees Kelvin (K).

As used herein, the term "indirect heat exchange" means the bringing of two fluids into heat exchange relation without any physical contact or intermixing of the fluids with each other.

As used herein, the term "feed air" means a mixture comprising primarily oxygen and nitrogen, such as ambient air.

As used herein, the terms "upper portion" and "lower portion" of a column mean those sections of the column respectively above and below the mid point of the column.

As used herein, the terms "turboexpansion" and "turboexpander" mean respectively method and apparatus for the flow of high pressure gas through a turbine to reduce the pressure and the temperature of the gas, thereby generating refrigeration.

As used herein, the term "cryogenic air separation plant" means the column or columns wherein feed air is separated by cryogenic rectification to produce nitrogen and, if desired, oxygen and/or argon, as well as interconnecting piping, valves, heat exchangers and the like.

As used herein, the term "compressor" means a machine that increases the pressure of a gas by the application of work.

As used herein, the term "nitrogen" means a fluid having a nitrogen concentration of at least 98 mole percent.

As used herein, the term "booster compressor" means a machine that increases the pressure of nitrogen leaving a turboexpander by the application of work generated by that turboexpander.

As used herein, the term "compression stage" means a single element, e.g. compression wheel, of a compressor through which gas is increased in pressure. A compressor must be comprised of at least one compression stage.

As used herein, the term "top condenser" means a heat exchange device that generates column downflow liquid from column vapor.

As used herein, the term "subcooler" means a heat exchanger wherein liquid is cooled by indirect heat exchange with one or more warming streams to be at a temperature lower than the saturation temperature of that liquid for the existing pressure.

BRIEF DESCRIPTION OF THE DRAWING

The sole FIGURE is a schematic representation of one preferred embodiment of the invention wherein the cryogenic air separation plant is a double column system comprising a higher pressure column and a lower pressure column.

DETAILED DESCRIPTION

The invention comprises a novel system for refrigerating a cryogenic air separation plant wherein a product nitrogen compressor is employed to elevate the pressure of refrigerant nitrogen prior to turboexpansion. The invention may be used for refrigerating a plant which produces only elevated pressure nitrogen, or one which produces oxygen and/or argon in addition to elevated pressure nitrogen.

The invention will be discussed in greater detail with reference to the Drawing. Referring now to the FIGURE, feed air 1, which has been cleaned of high boiling impurities such as water vapor, carbon dioxide and hydrocarbons, is cooled by indirect heat exchange with return streams in primary heat exchanger 101. Primary heat exchanger 101 may be a unitary piece although the primary heat exchanger could, and preferably does, comprise a plurality of modules. The cleaned and cooled feed air 2 is then passed from primary heat exchanger 101 to the cryogenic air separation plant, which in the embodiment illustrated in the FIGURE comprises higher pressure column 102 and lower pressure column 104. In this embodiment feed air 2 is passed into higher pressure column 102.

Higher pressure column 102 is operating at a pressure generally within the range of from 90 to 150 pounds per square inch absolute (psia). Within higher pressure column 102 the feed air is separated by cryogenic rectification into oxygen-enriched liquid and higher pressure nitrogen vapor. Oxygen-enriched liquid is withdrawn from the lower portion of higher pressure column 102 in stream 3 and passed to subcooler 106 wherein it is subcooled. The subcooled oxygen-enriched liquid is then passed in stream 4 to valve 113 and then as stream 5 into lower pressure column 104 which is operating at a pressure less than that of higher pressure column 102 and generally within the range of from 50 to 75 psia.

The feeds passed into lower pressure column 104 are separated by cryogenic rectification into lower pressure nitrogen vapor and oxygen liquid. Higher pressure nitrogen vapor from the higher pressure column is passed in line 6 to main condenser or reboiler 103 wherein it is condensed by indirect heat exchange with boiling oxygen liquid to provide vapor upflow for column 104. The resulting condensed higher pressure nitrogen is returned to column 102 in line 9 as reflux. Oxygen liquid is withdrawn from the lower portion of column 104 in line 11 and subcooled by passage through subcooler 106. Subcooled oxygen liquid in stream 12 is passed through valve 114 and as stream 13 into top condenser 105.

Lower pressure nitrogen vapor from the upper portion of lower pressure column 104 is passed in line 16 to top condenser 105 wherein it is condensed by indirect heat exchange with boiling subcooled oxygen provided to top condenser 105 in stream 13. The resulting condensed lower pressure nitrogen is returned to column 104 in line 19 as reflux. If desired, a portion 20 of the condensed lower pressure nitrogen may be recovered as product liquid nitrogen. The vaporized oxygen is withdrawn from top condenser 105 in stream 14, warmed by passed through subcooler 106 and primary heat exchanger 101, and removed from the system in stream 25.

Nitrogen is passed from the cryogenic air separation plant to the primary heat exchanger and then to the product compressor. In the embodiment illustrated in the FIGURE, nitrogen from both the higher pressure column and the lower pressure column is passed to the product compressor. Referring back to the FIGURE, nitrogen is passed from the upper portion of higher pressure column 102 to primary heat exchanger 101 and then to product compressor 110. In the embodiment of the invention illustrated in the FIGURE, a portion of stream 6 is passed as nitrogen stream 7 to subcooler 106 wherein it is warmed and then passed from subcooler 106 in stream 10 to primary heat exchanger 101 wherein it is further warmed. The resulting nitrogen is withdrawn from primary heat exchanger 101 in stream 31 and passed to product compressor 110.

A portion of stream 16 is passed as nitrogen stream 17 to subcooler 106 wherein it is warmed and then passed from subcooler 106 in stream 22 to primary heat exchanger 101 wherein it is further warmed. The resulting nitrogen is withdrawn from primary heat exchanger 101 in stream 23 and passed to product compressor 110.

Product compressor 110 comprises from 2 to 6 stages. A portion of the compressed nitrogen is withdrawn, preferably from an intermediate point, i.e. a point after the first stage but before the final stage, of product compressor 110 and passed as refrigerant nitrogen stream 26 to primary heat exchanger 101 wherein it is cooled, and then passed in stream 34 from primary heat exchanger 101 to turboexpander 109 wherein it is turboexpanded to generate refrigeration. The resulting refrigeration bearing refrigerant nitrogen is passed in stream 28 from turboexpander 109 to primary heat exchanger 101 wherein it is warmed to provide cooling to the feed air. The resulting refrigerant nitrogen is then passed in stream 29 from primary heat exchanger 101 to booster compressor 108.

The FIGURE illustrates two different modes of the operation of this invention. In a first mode, which is employed when little or no liquid nitrogen product is recovered, e.g. when stream 20 is not employed, refrigerant nitrogen is withdrawn from after a lower or upstream stage, e.g. after the first compression stage, of product compressor 110 in stream 43, passed through valve 120, and as stream 45 used to form aforesaid stream 26. In a second mode, which is employed when liquid nitrogen product is recovered, i.e. when stream 20 is employed, refrigerant nitrogen is withdrawn from a higher or downstream stage of product compressor 110 in stream 42, passed through valve 119 and as stream 44 used to form aforesaid stream 26. In this second mode stream 42 may be taken from after the final stage of compression of compressor 110. Generally in the first mode stream 26 will be at a pressure within the range of from 50 to 340 psia, and in the second mode stream 26 will be at a pressure within the range of from 90 to 700 psia.

Preferably, as shown in the FIGURE, booster compressor 108 is mechanically coupled to turboexpander 109 and turboexpander 109 serves to drive booster compressor 108. Nitrogen in stream 29 is compressed to a pressure generally within the range of from 20 to 390 psia in booster compressor 108. Resulting boosted nitrogen 35 is cooled of the heat of compression in aftercooler 111 to form boosted nitrogen stream 30 which is passed to primary product compressor 110. In the first mode described above when little or no liquid nitrogen product is recovered, the boosted nitrogen is passed in line 47 through valve 122 and as stream 49 is combined with stream 23 for passage to an upstream stage, such as the inlet, of product compressor 110 at a pressure within the range of from 20 to 220 psia. In the second mode described above when liquid nitrogen product is recovered, the boosted nitrogen is passed in line 46 through valve 121 and as stream 48 is combined with stream 31 for passage to product compressor 110 at a pressure within the range of from 50 to 390 psia. As can be seen from the FIGURE stream 31 is passed to product compressor 110 at a stage downstream of the stage of compression to which stream 23 is passed to product compressor 110. Nitrogen is withdrawn from the final stage of primary product compressor 110 in stream 32 and recovered as product elevated pressure nitrogen having a pressure generally within the range of from 150 to 5000 psia.

The invention takes advantage of the fact that further compression of the nitrogen product is required after exiting the primary heat exchanger. By pulling only a fraction, generally from about 3 to 25 percent, of the nitrogen vapor flow from the primary product compressor for refrigeration, the bulk of the primary product compressor flow provided to the primary product compressor remains unchanged, regardless of the refrigeration demand. In addition, since the nitrogen vapor is turboexpanded to generate refrigeration and then passed to the booster compressor, and not the other way around, the refrigerant operating pressures remain reasonable regardless of liquid demand.

Variations of the arrangement illustrated in the FIGURE include the use of parallel turbine-booster compressor systems where wide liquid making range capability is important.

Although the invention has been described in detail with reference to certain preferred embodiments, those skilled in the art will recognize that there are other embodiments of the invention within the spirit and scope of the claims.

The invention claimed is:

1. Cryogenic air separation apparatus for producing elevated pressure nitrogen comprising:

(A) a primary heat exchanger, a cryogenic air separation plant, and means for passing feed air to the primary heat exchanger and from the primary heat exchanger to the cryogenic air separation plant;

(B) a product compressor having a plurality of stages, a turboexpander, means for passing nitrogen from the cryogenic air separation plant to the primary heat exchanger and from the primary heat exchanger to the product compressor, and means for passing nitrogen from the product compressor to the primary heat exchanger and from the primary heat exchanger to the turboexpander;

(C) a booster compressor, means for passing nitrogen from the turboexpander to the primary heat exchanger and from the primary heat exchanger to the booster compressor, and means for passing nitrogen from the booster compressor to the product compressor; and (D) means for recovering elevated pressure nitrogen from the product compressor.

2. The apparatus of claim 1 wherein the cryogenic air separation plant comprises a higher pressure column and a lower pressure column.

3. The apparatus of claim 2 wherein nitrogen from both the higher pressure column and the lower pressure column is passed to the product compressor.

4. The apparatus of claim 1 wherein the booster compressor is mechanically coupled to the turboexpander.

5. The apparatus of claim 2 further comprising a top condenser, means for passing fluid from the lower portion of the lower pressure column to the top condenser, and means for passing fluid from the top condenser to the primary heat exchanger.

6. The apparatus of claim 1 further comprising a subcooler, wherein the means for passing nitrogen from cryogenic air separation plant to the primary heat exchanger includes the subcooler.

7. The apparatus of claim 1 further comprising means for recovering liquid product from the cryogenic air separation plant.

8. The apparatus of claim 1 wherein the means for passing nitrogen from the product compressor to the primary heat exchanger draws nitrogen from an intermediate point of the product compressor.

9. The apparatus of claim 1 wherein the means for passing nitrogen from the product compressor to the primary heat exchanger comprises a first conduit having a valve and which communicates with the product compressor at a first position, and a second conduit having a valve and which communicates with the product compressor at a second position which is downstream of the first position.

10. The apparatus of claim 1 wherein the means for passing nitrogen from the booster compressor to the product compressor comprises conduit means for passing nitrogen to an upstream stage of the product compressor and conduit means for passing nitrogen to the product compressor downstream of said upstream stage of the product compressor.

11. A method for producing elevated pressure nitrogen comprising:

(A) cooling feed air in a primary heat exchanger, passing the cooled feed air into a cryogenic air separation plant, and producing nitrogen by cryogenic rectification within the cryogenic air separation plant;

(B) warming nitrogen withdrawn from the cryogenic air separation plant in the primary heat exchanger, compressing the warmed nitrogen in a product compressor, passing a portion of the compressed nitrogen as refrigerant nitrogen to the primary heat exchanger, cooling the refrigerant nitrogen, and turboexpanding the refrigerant nitrogen to generate refrigeration;

(C) warming the turboexpanded refrigerant nitrogen in the primary heat exchanger, compressing the turboexpanded refrigerant nitrogen in a booster compressor, and passing the resulting refrigerant nitrogen to the product compressor; and (D) recovering elevated pressure nitrogen from the product compressor.

12. The method of claim 11 further comprising recovering liquid product from the cryogenic air separation plant.

13. The method of claim 11 wherein the warming of the turboexpanded refrigerant nitrogen in the primary heat exchanger serves to provide at least some of the cooling of the feed air.

14. The method of claim 11 wherein the refrigerant nitrogen is passed from the product compressor after less than the entire number of stages of the product compressor.

15. The method of claim 11 wherein the refrigerant nitrogen is passed from the product compressor after the entire number of stages of the product compressor.

16. The method of claim 11 carried out in two operating modes wherein in a first mode the refrigerant nitrogen passed to the primary heat exchanger has a pressure within the range of from 50 to 340 psia and the resulting refrigerant nitrogen passed to the product compressor has a pressure within the range of from 20 to 220 psia, and in a second mode the refrigerant nitrogen passed to the primary heat exchanger has a pressure within the range of from 90 to 700 psia and the resulting refrigerant nitrogen passed to the product compressor has a pressure within the range of from 50 to 390.

17. The method of claim 11 carried out in two operating modes wherein in a first mode the refrigerant nitrogen is passed to the primary heat exchanger from an upstream stage of the product compressor, and in a second mode the refrigerant nitrogen is passed to the primary heat exchanger from a stage downstream of said upstream stage.

18. The method of claim 11 carried out in two operating modes wherein in a first mode the resulting refrigerant nitrogen is passed to an upstream stage of the product compressor, and in a second mode the resulting refrigerant nitrogen is passed to a stage of the product compressor which is downstream of said upstream stage.

19. The method of claim 11 wherein the refrigerant nitrogen comprises from 3 to 25 percent of the compressed nitrogen.

* * * * *